United States Patent [19]

Mumford

[11] 4,333,577

[45] Jun. 8, 1982

[54] TAMPERPROOF CLOSURE

[75] Inventor: George V. Mumford, Toledo, Ohio

[73] Assignee: Owens-Illinois, Inc., Toledo, Ohio

[21] Appl. No.: 186,938

[22] Filed: Sep. 15, 1980

[51] Int. Cl.[3] ..... B65D 41/34

[52] U.S. Cl. ..... 215/246; 215/252

[58] Field of Search ..... 215/252, 246, 256; 53/488, 442

[56] References Cited

U.S. PATENT DOCUMENTS

| | | | |
|---|---|---|---|
| 2,085,367 | 6/1937 | Jacob . | |
| 2,099,097 | 11/1937 | Beider et al. . | |
| 2,162,712 | 6/1939 | Hamberger . | |
| 3,329,295 | 7/1967 | Fields . | |
| 3,424,330 | 1/1969 | Marcel . | |
| 3,438,528 | 4/1969 | Fields . | |
| 3,650,428 | 3/1972 | Miller . | |
| 3,720,343 | 3/1973 | Irish, Jr. . | |
| 3,737,064 | 6/1973 | Patel et al. . | |
| 3,874,540 | 4/1975 | Hidding | 215/252 |
| 3,901,403 | 8/1975 | Menke | 215/251 |
| 3,980,195 | 9/1976 | Fillmore | 215/252 X |
| 4,033,472 | 7/1977 | Aichinger | 215/256 |
| 4,076,140 | 2/1978 | Perne | 215/256 |
| 4,147,268 | 4/1979 | Patel et al. | 215/252 |
| 4,206,852 | 6/1980 | Dunn et al. | 215/252 |

FOREIGN PATENT DOCUMENTS

| | | | |
|---|---|---|---|
| 1438648 | 6/1976 | United Kingdom | 215/252 |

*Primary Examiner*—Donald F. Norton
*Attorney, Agent, or Firm*—John R. Nelson; Myron E. Click; David H. Wilson

[57] ABSTRACT

A molded thermoplastic closure having a heat shrinkable tamperproof band integrally attached to the lower outside circular edge of the closure skirt by means of circumferentially spaced bridge members. The outside diameter of the tamperproof band is greater than the outside diameter of the skirt, so that the tamperproof band extends at least partially beyond the circular lower skirt edge. The upper edge of the band can be located outside the skirt edge and be connected thereto only by the bridge members, or it can be located partially beneath the skirt and be directly integrally connected thereto through an annular region.

2 Claims, 4 Drawing Figures

TAMPERPROOF CLOSURE

BACKGROUND OF THE INVENTION

The invention relates to tamperproof closures, and in particular the type having an annular heat-shrinkable band depending from the lower edge of the skirt. Such tamperproof closures typically have a circular panel, and a threaded annular skirt depending from the panel. After the closure is applied to a bottle neck, heat is applied to the tamperproof band depending from the skirt causing the tamperproof band to shrink into shape-conforming engagement with the bottle neck. When the closure is removed from the neck, the tamperproof band breaks away on a circumferential weakened tear line at its attachment to the skirt. The condition of the tamperproof band can therefore be used to indicate whether there has been an attempt to tamper with or open the container.

The molding of such closures presents some difficulties, however. The desired weakness at the attachment of the tamperproof band to the skirt, which permits the tamperproof band to be torn from the skirt, also renders the closure relatively fragile during the molding operation. It cannot withstand any severe stripping action during removal from the mold. Furthermore, the tear line is typically formed by an annular groove or a circumferential line of perforations. Mold members which create the groove or perforations interfere with the axial removal of the closure from the mold. Such interference could, of course, be eliminated by the use of a radially opening mold. However, as such radially opening molds are relatively complicated and expensive, it is generally desirable to avoid their use where possible.

A closure design which eliminates the necessity of a radially opening mold is disclosed in U.S. Pat. No. 4,033,472 to Aichinger, assigned to Albert Obrist AG. The so called Obrist closure disclosed in the Anchinger patent has a tamperproof band which tapers from a thin sectioned connection at the lower edge of the skirt down to a thicker lower portion of the tamperproof band. The Obrist tamperproof band is integrally attached to the inside circular lower edge of the skirt.

The tamperproof band of the Obrist closure has an outside diameter which increases as the axial distance from the lower edge of the skirt increases. Therefore, the tamperproof band interefers with the axial removal of the mold member which defines the outer surface of the tamperproof band. Due to its thinness and flexibility, however, the tamperproof band is deformable to permit the axial removal of the mold member. A smoothly contoured taper of the tamperproof band facilitates this deformation and the stripping of the closure from the mold. Even so, such stripping action is an undesirable, relatively unreliable and troublesome step in the manufacturing process. Moreover, if perforations are to be molded into the closure to form the tear line, the problem of interference between the mold and the tamperproof band increases.

When the weakened line of attachment between the tamperproof band and the skirt is perforated, the thickness of the tamperproof band becomes more critical. During the molding process, the flow of thermoplastic material into the mold cavity defining the tamperproof band is only through the relatively narrow bridges between the perforations. Relatively narrow streams of thermoplastic material flow through these bridges and expand into the cavity beyond to form a tamperproof band. The lines where these expanding streams again meet are referred to as "cold-weld lines", and form an undesirable weak point in the tamperproof band. If the tamperproof band breaks prematurely on weakened cold weld lines, the band is no longer effective to indicate whether there has been an attempt to remove the closure. The thickness and taper of the tamperproof band is critical both for minimizing the cold weld problem, and for providing the required heat-shrinkable properties. Yet the taper required for permitting axial separation of mold members forming an Obrist type closure may not be ideal also for minimizing the cold weld problem.

A useful improvement in an Obrist type closure reduces or eliminates the stripping action of interfering mold members and closure portions, provides for the possibility of a tamperproof band having a uniform thickness, or other desired taper, and allows the closure to be designed for different degrees of tearability, without requiring an expensive mold structure having radially opening components.

SUMMARY OF THE INVENTION

The invention provides an improved closure having a heat-shrinkable tamperproof band integrally attached thereto. The closure comprises a generally disc shaped panel, an annular skirt depending from the periphery of the panel, and a relatively thin, heat-shrinkable tamperproof band integrally attached to and depending from the lower edge of the skirt. The skirt terminates in a generally horizontal, downwardly facing annular surface. The thin tamperproof band is attached to the outside of this annular surface, by means of integral bridges between the skirt and the tamperproof band. The band may be completely outside an axial extension of the skirt surface, in which case it is attached only by the radially extended bridges. Alternatively, the band may be located partially underneath the skirt, in which case there is also a continuous circumferential attachment between the top edge of the tamperproof band and the bottom edge of the skirt. In either case, the outside diameter of the tamperproof band is greater than the outside diameter of the skirt.

Because of the location of the tamperproof band, its outer surface may be defined during the molding process by the same mold member which defines the outer surfaces of the skirt and panel. Therefore, there need be no interference between the tamperproof band and the mold member even though the tamperproof band have an outwardly tapering surface, or an abrupt transition between a narrow frangible attachment to the skirt and a somewhat thicker heat-shrinkable portion of the band.

DESCRIPTION OF THE PREFERRED EMBODIMENT

Figure 4:
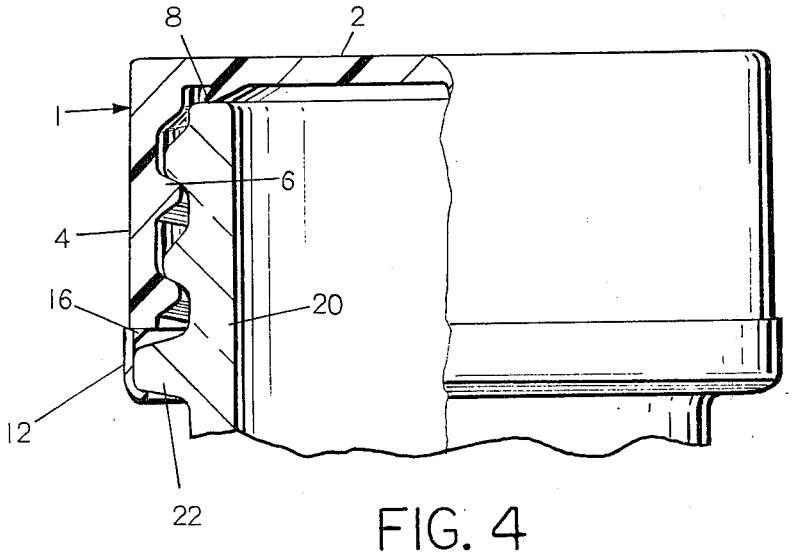
FIG. 4 is an elevational view, partly in section, of the closure of FIG. 1 disposed on a container finish, with the tamperproof band heat shrunk into shape-conforming engagement therewith.

As illustrated in the drawing a closure 1 embodying the present invention is generally cylindrical and comprises a disc shaped panel 2, an annular skirt 4 depending from the periphery of the panel, and a relatively thin annular band 12 integrally attached to the bottom of the skirt 4. On the inside cylindrical surface of the skirt 4, threads 6 are formed to cooperate with corresponding threads on a bottle neck. On the top inside surface of the panel 2, a depending annular sealing member 8 may be integrally formed. When the closure 1 is tightened onto a cooperating container neck, the member 8 is compressed against the top surface of the neck to create a liquid seal as illustrated in FIG. 4. Alternatively, a compressible liner or any other conventional sealing means could be employed.

Figure 1:
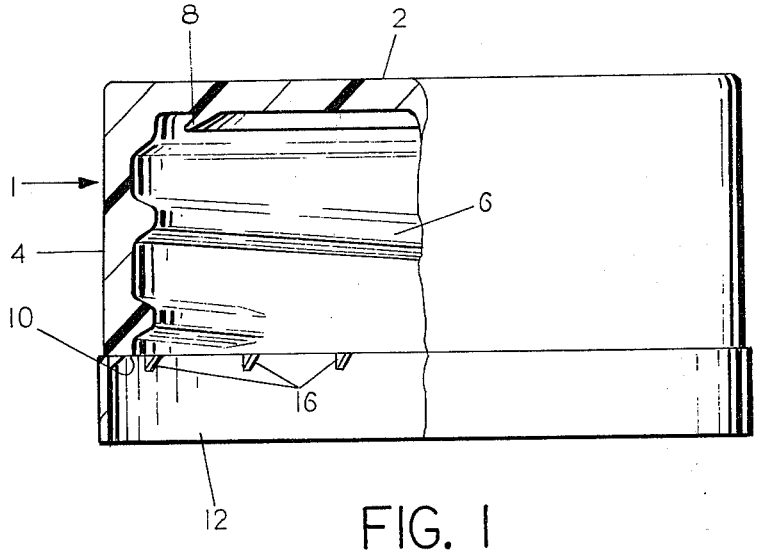
FIG. 1 is a side elevational view, partly in section, of a tamperproof closure embodying the present invention.
Figure 2:
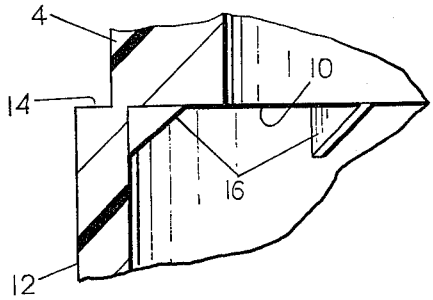
FIG. 2 is an enlarged scale sectional view of a portion of the closure illustrated in FIG. 1, showing in detail the structure by which the tamperproof band is attached to the skirt.

The skirt 4 terminates at its lower end in an annular surface 10, which is downwardly facing and generally parallel to the panel 2. Integrally attached to the bottom outside circular edge of the skirt 6 is a shrinkable, relatively thin, tamperproof band 12. In the embodiment illustrated in FIGS. 1 and 2, the top end surface 14 of the tamperproof band is integrally attached to the annular skirt end surface 10. Most of the tamperproof band top surface 14, however, lies radially beyond the outer edge of the skirt 4. Therefore, the line of attachment between the skirt 4 and the tamperproof band 12 is relatively narrow, and frangible. In this embodiment, the outside diameter of the tamperproof band 12 is greater than the outside diameter of the skirt 4. Therefore, the same mold member may define the outside surfaces of the panel 2, the skirt 4, and the tamperproof band 12. A mold member may be axially moved relative to the molded closure without interference from the closure 1 despite the abrupt transitional surface 14 and despite any outward taper of the outside surface of the tamperproof band 12. Alternatively, the outside annular surface of the tamperproof band could be a continuous axial extension of the outside surface of the skirt. Such a configuration would also eliminate interference during stripping from a mold.

A plurality of radially extended bridges 16 integrally connect the bottom surface 10 of the skirt 4 and the inside surface of the tamperproof band 12. The number and extent of the bridges 16 may be varied to provide different degrees of tearability required for different specific product and customer uses.

Figure 3:
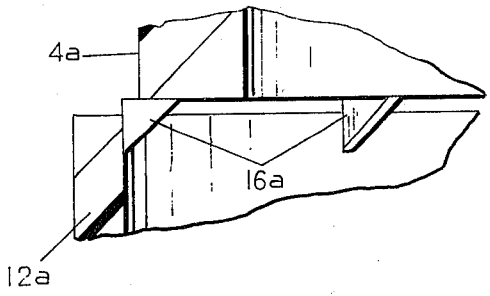
FIG. 3 is an enlarged scale sectional view similar to FIG. 2, but illustrating an alternative structure for attaching the tamperproof band to the skirt.

In the alternative embodiment illustrated in FIG. 3, the tamperproof band **12*a* is located entirely outside an axial extension of the generally cylindrical outside surface of the skirt 4*a*, thereby providing a lesser degree of attachment. The tamperproof band 12*a* is attached to skirt 4*a* only by means of a plurality of circumferentially spaced radial bridges 16*a***.

As illustrated in FIG. 4, after the bottler applies the closure 1 to a container finish 20 and heats the tamperproof band 12, the tamperproof band 12 shrinks into shape-conforming engagement with a bead 22 on the finish 20. The narrow annular connection between the bottom surface 10 of the tamperproof band 12 forms a predetermined tear line. If any attempt is made to remove the closure 1 from the finish 20, the tamperproof band 12 will sever along this tear line, thereby providing an indication of tampering.

Modifications of the invention described and illustrated herein will be apparent to those skilled in the art, and it is intended that the scope of the invention be determined solely by the appended claims.

What is claimed is:

1. A molded thermoplastic closure comprising a disc-shaped panel, and annular skirt depending from the periphery of said panel, a heat shrinkable annular band disposed in depending relation from the annular bottom edge of said skirt, said band having an outside diameter adjacent said annular bottom edge greater than the outside diameter of said skirt bottom edge and an inside diameter adjacent said annular bottom edge less than the outside diameter of said skirt adjacent to said edge, thereby defining a continuous shearable annular connection between said annular bottom edge of said skirt and the top annular portion of said band.

2. The closure of claim 1 wherein said shearable annular connection of said band to said skirt is reinforced by a plurality of circumferentially spaced, radially extending bridges integrally attaching said band to said skirt.

* * * * *